US010052522B2

(12) United States Patent
Green et al.

(10) Patent No.: US 10,052,522 B2
(45) Date of Patent: Aug. 21, 2018

(54) BRAKE BAR

(71) Applicant: CMC Rescue, Inc., Goleta, CA (US)

(72) Inventors: Mark Joseph Green, Sebastopol, CA (US); W. Thomas Greer, Sebastopol, CA (US)

(73) Assignee: CMC Rescue, Inc., Goleta, CA (US)

( * ) Notice: Subject to any disclaimer, the term of this patent is extended or adjusted under 35 U.S.C. 154(b) by 269 days.

(21) Appl. No.: 14/861,146

(22) Filed: Sep. 22, 2015

(65) Prior Publication Data

US 2016/0096041 A1 Apr. 7, 2016

Related U.S. Application Data

(60) Provisional application No. 62/059,341, filed on Oct. 3, 2014.

(51) Int. Cl.

| | |
|---|---|
| ***A63B 29/08*** | (2006.01) |
| ***A63B 29/02*** | (2006.01) |
| ***A62B 1/14*** | (2006.01) |

(52) U.S. Cl.

CPC ..... *A63B 29/02* (2013.01); *A62B 1/14* (2013.01)

(58) Field of Classification Search

CPC .. B66D 3/04; B66D 5/16; A63B 29/08; A62B 1/14; A62B 1/18

See application file for complete search history.

(56) References Cited

U.S. PATENT DOCUMENTS

| | | | | | |
|---|---|---|---|---|---|
| 3,217,840 | A * | 11/1965 | Holkesvick | A62B 1/06 | 182/5 |
| 4,019,609 | A * | 4/1977 | Wagner | A62B 1/06 | 182/5 |
| 4,687,077 | A * | 8/1987 | Bobick | A62B 1/10 | 182/235 |
| 5,145,036 | A * | 9/1992 | Omalia | A62B 1/04 | 182/193 |
| 5,295,559 | A * | 3/1994 | Nutkins | A62B 1/04 | 182/191 |
| 6,062,340 | A * | 5/2000 | Walker | A62B 1/04 | 182/192 |
| 6,131,697 | A * | 10/2000 | Bassett | A62B 1/04 | 182/192 |
| 7,648,126 | B2 * | 1/2010 | Lipke | A62B 1/06 | 254/389 |
| 7,866,634 | B2 | 1/2011 | Lipke | | |
| 8,495,800 | B2 | 7/2013 | Lipke | | |
| 8,950,550 | B2 * | 2/2015 | Maurice | A62B 1/14 | 182/193 |
| 9,119,978 | B1 * | 9/2015 | Bassett | A62B 1/04 | |

* cited by examiner

*Primary Examiner* — Emmanuel M Marcelo
(74) *Attorney, Agent, or Firm* — McCoy Russell LLP

(57) ABSTRACT

A brake bar assembly having a U-shaped frame, a sliding friction bar positioned on the U-shaped frame near a closed end of the frame, a fixed friction bar attached to an open end of the U-shaped frame, and a lockable center bar assembly positioned on the U-shaped frame between the sliding friction bar and the fixed friction bar having a spring operated locking mechanism which allows the center bar to be releasably pivoted on the frame.

17 Claims, 5 Drawing Sheets

BRAKE BAR

CROSS-REFERENCE TO RELATED APPLICATION(S)

This application claims priority to and the benefit of U.S. Provisional Application No. 62/059,341 filed Oct. 3, 2014, the entire contents of which are incorporated here and by reference.

BACKGROUND OF THE INVENTION

This invention relates to a rope control device, and more specifically to rope control device commonly known as a "brake bar" having a locking mechanism that prevents the bar from rotating unintentionally during use. The brake bar is a device utilized for controlling rope and, more particularly, to allow rope to be played out under control while under loads. Utilization of ropes are an essential part of a wide variety of activities related to health and safety, law enforcement, rescue, construction and recreation. In particular, the need often exists for a user to use a rope to control the movement of one object such as a load relative to another object such as an anchor point. Typically, but not necessarily, the anchor point is a fixed location on a structural number such a tree, building, or the like and the load is moved relative to the anchor point. However , the anchor point may be formed on a movable object and the load can take many different forms such as supplies, equipment, an injured person, or in the case of repelling, the person using the rope. The construction and use of general purpose rope rigging devices such as tackle blocks, belay devices, ascenders, carabiners, and pulleys are well known. In addition, numerous rigging devices have been developed specifically to facilitated the use of ropes to control movement of a load relative to an anchor point.

The present invention is directed to a class of devices known as a brake bar or rack generally known to comprise of an external frame formed by a U-shaped piece of metal that defines first and second legs and one or more cross-bars that can be pivoted about the first leg of the frame relative to the second leg of the frame. Previous brake bar configurations, in order to provide ample versatility of positioning and load amounts, have involved having several bars to allow the user to set up the rope system in whatever configuration was demanded of the situation. However, this requires that the device be large and cumbersome which could mean eliminating other necessary gear a rescuer could potentially be carrying in favor of having this device.

To address this problem there are brake bar devices that are available to reduce the size of weight by only having one central bar. The central bars of these devices generally lack a locking mechanism, relying upon the force of the rope to keep the bar in the engaged position. Another drawback of these devices is that the center bars tend to only be available to rotate in one direction when disengaging.

Consequently, a need exists for an improved brake bar device which addresses the drawbacks of prior brake bar designs which is a reduced in size and weight and provides for a locking mechanisms that prevents the center bar from rotating unintentionally during use.

SUMMARY OF THE INVENTION

The present invention is directed to a brake bar device with a sliding center bar that utilizes a locking mechanism that prevents the center bar from rotating unintentionally during use. The brake bar includes a U-shaped frame having a fixed friction bar positioned at one end of the frame, a sliding friction bar attached at an opposite end of the frame and a lockable center bar assembly positioned in between the fixed friction bar and the sliding friction bar. Allowing one end bar to slide along the frame provides the user the ability to compress the rope between the sliding friction bar and the center bar. This provides increased friction force without the need for added bars.

The lockable center bar is designed so that there are three steps required to remove the rope, preventing any unintentional release. A release button is depressed so that the center bar can be pulled away from the frame allowing the center bar to be swung open. Once the rope has pulled into the opening in the frame, the user rotates the center bar back towards a closed position and a spring snaps the center bar shut into a locking position. From a locking position, the release button is returned to a locked position wherein two balls lock the center bar in place. Manipulation of the release button combined with the effort of sliding the center bar back and rotating it to an open position, gives the user noticeable tactile feedback that the bar is disengaged. Additionally, the center bar can rotate in either direction to disengage providing easy, ambidextrous use. This design results in the center bar not relying on forces from the rope to keep it engaged with the frame preventing any unintentional opening of the center bar which could disengage the device from the rope.

To increase versatility of the end bars, the end bars have curved extensions which provides a means of tying knots on the device. For use during repelling, this makes it possible to arrest the user's descent quickly, and at any point in a rescue operation. These and other features of the invention will be further understood by reference to the accompanying drawings and detailed description herein.

DETAILED DESCRIPTION OF THE DRAWINGS

Figure 1:
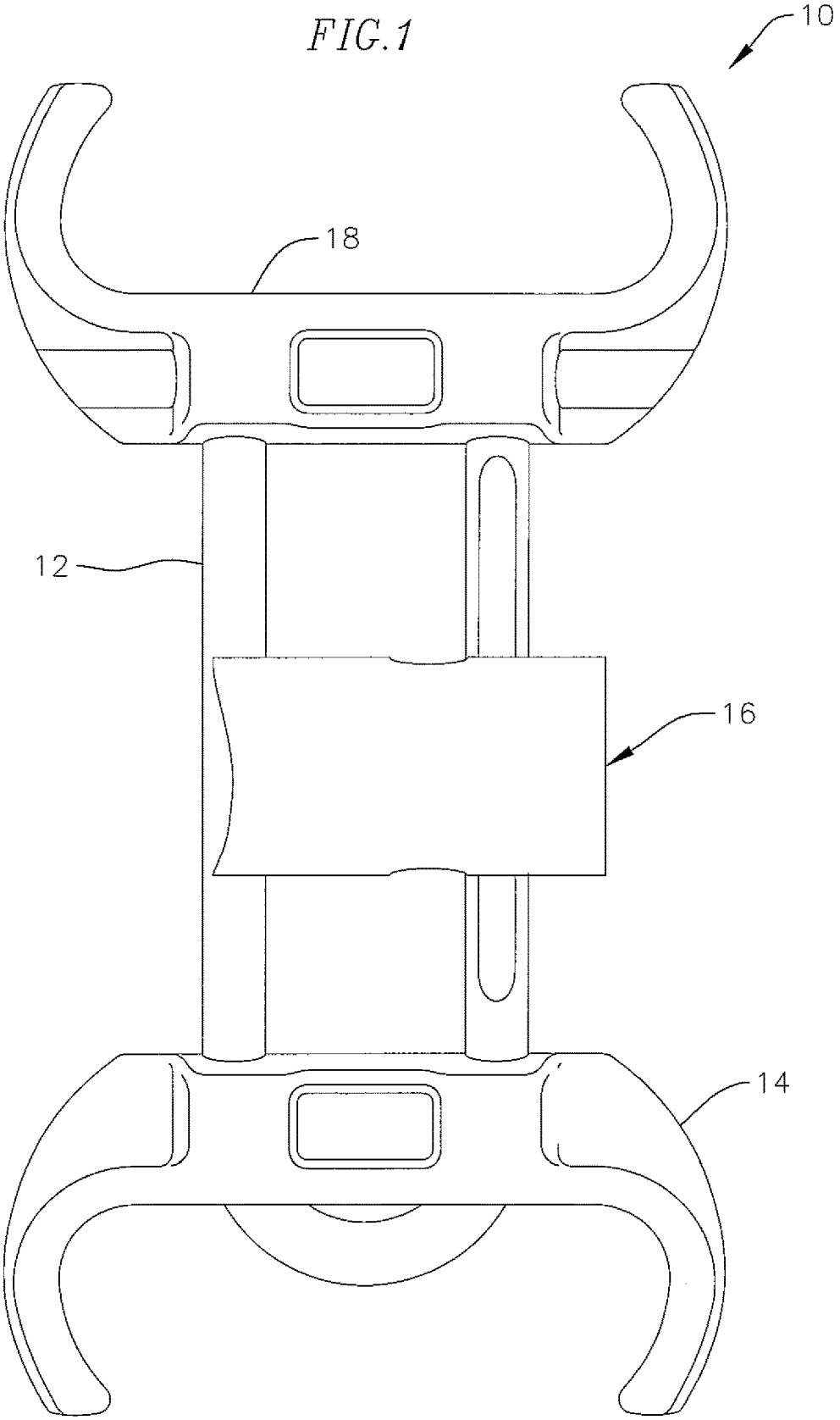
FIG. 1 is a front view of the brake bar of the present invention.
Figure 2:
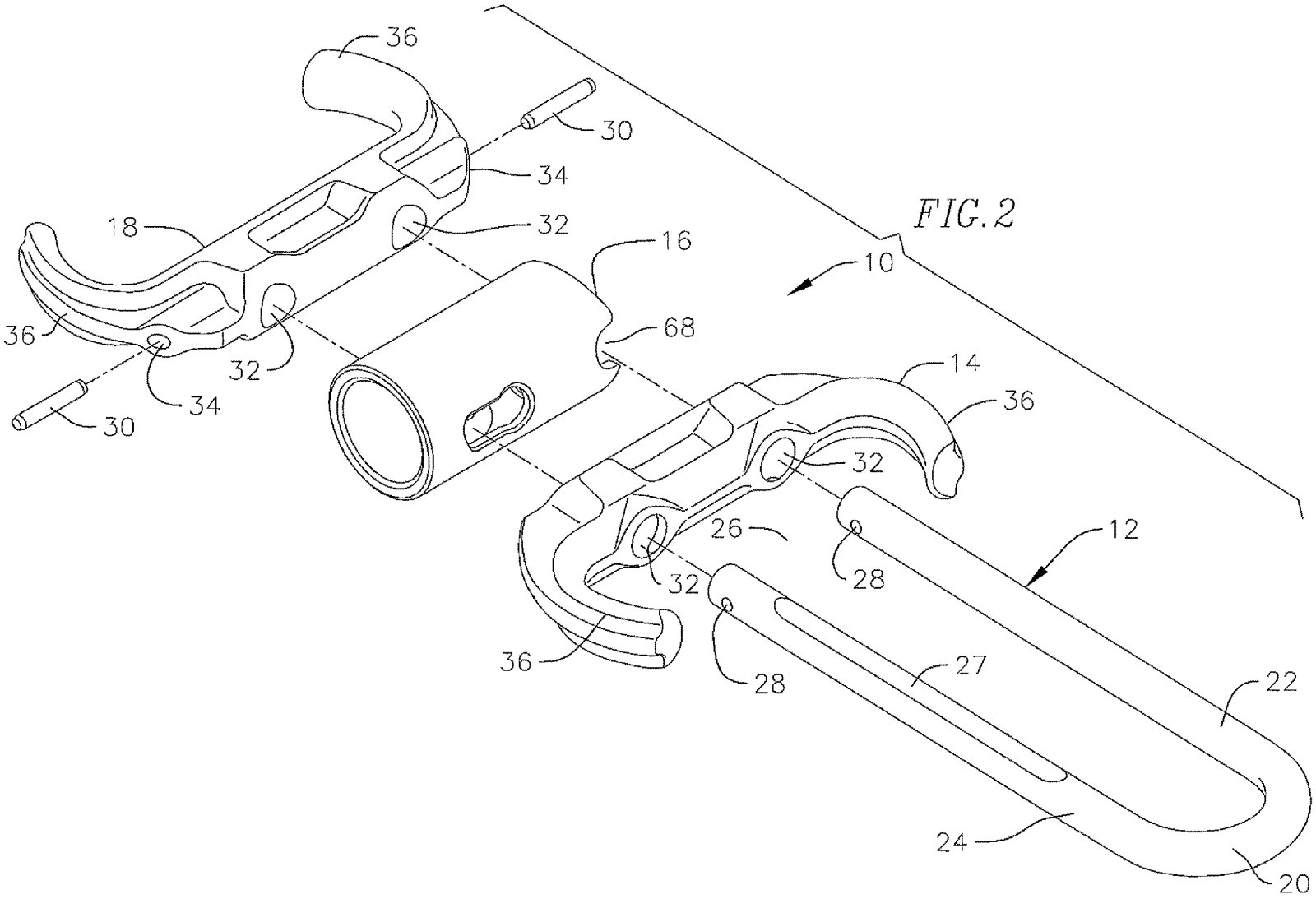
FIG. 2 is an exploded perspective view of the brake bar of FIG. 1.

As shown in FIGS. 1 and 2, a rope control device or brake bar 10 of the present invention is illustrated. The brake bar includes a U-shaped frame 12, a sliding friction bar 14, a lockable center bar assembly 16 and a fixed friction bar 18. The U-shaped frame 12 includes a closed end portion 20, two-side leg portions 22 and 24 extending from the closed end portion and an open end portion 26. Side leg portion 24 has a flattened surface 27 to be discussed in more detail subsequently herein. Side leg portions 22 and 24 have holes 28 extending therethrough adjacent the open end portion 26 for receipt of pins 30 for attaching the fixed friction bar 18 on the open end portion 26 of the U-shaped frame. Sliding friction bar 14 includes holes 32 for receipt of the side leg portions 22 and 24 to retain the sliding friction bar on the U-shaped frame adjacent the closed end 20, although in use, sliding friction bar 14 can slide along the length of the side leg portions 22 and 24.

Similarly fixed friction bar 18 includes holes 32 for receipt of end portions of side leg portions 22 and 24 and side holes 34 for receipt of the pins 30 to retain the fixed friction bar 18 on the open end 26 of the U-shaped frame. Holes 34 and 28 are aligned for receipt of pins 30. Both sliding friction bar 14 and fixed friction bar 18 have curved portions or horns 36 projecting outwardly on either end of the friction bar. The lockable center bar assembly 16 is positioned on the U-shaped frame 12 between the sliding friction bar 14 and the fixed friction 18. The fixed friction bar 18 captures the sliding friction bar and the lockable center bar assembly on the U-shaped frame and defines the limit for sliding of the sliding friction bar and the lockable center bar assembly.

Figure 3:
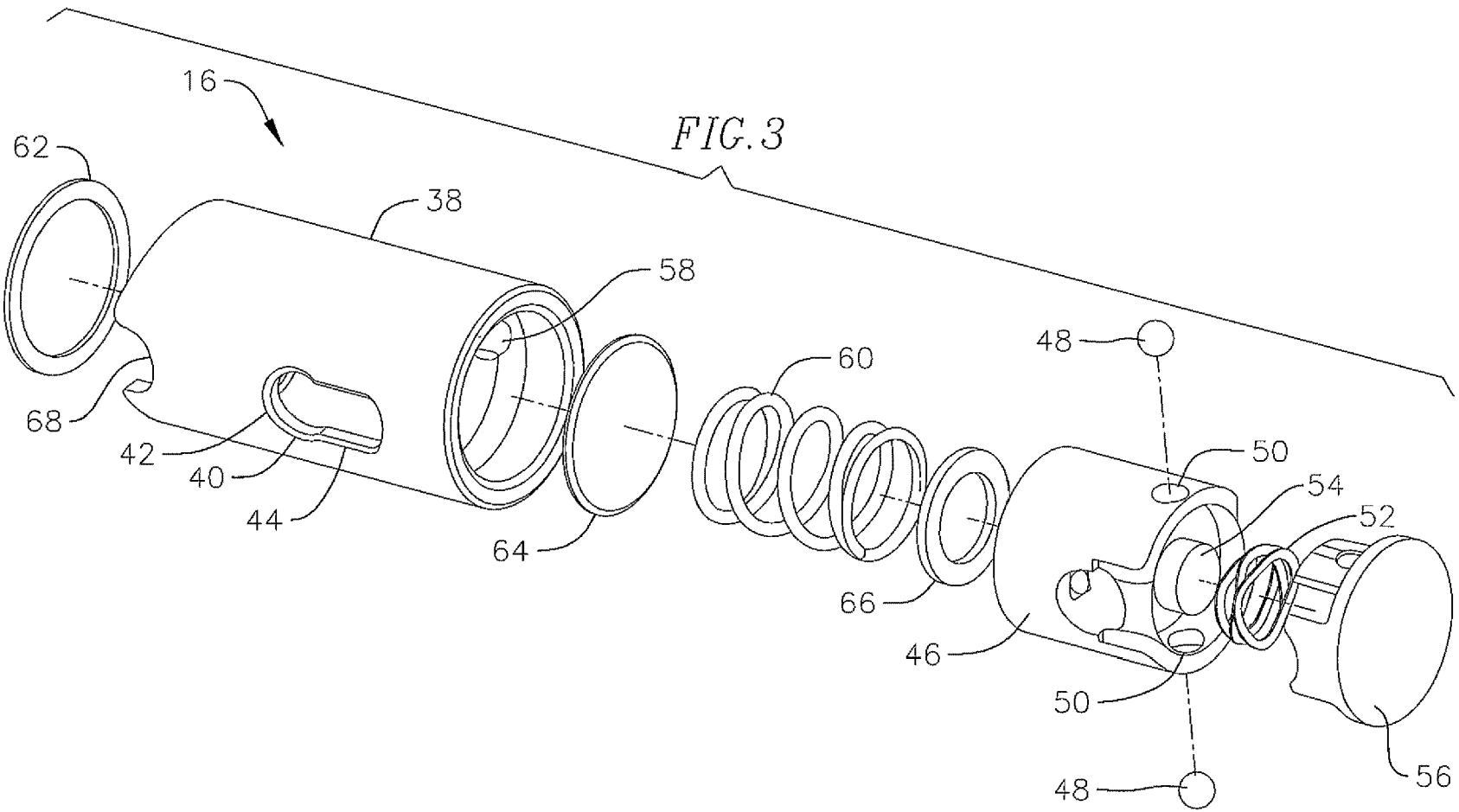
FIG. 3 is an exploded, detailed view of the center bar assembly.

As seen best in FIG. 3, the lockable center bar assembly 16 comprises a cylindrical center bar 38 having a slotted hole 40 having a circular end portion 42 sized to receive the dimension of cylindrical side leg portion 24 and a slotted portion 44 sized to receive the dimension of flattened surface 27. The center bar has an internal mechanism or lifer 46 positioned therein which has balls 48 positioned within channels 50 which are activated by a button spring 52 positioned around a rod 54 on an end of the lifer. A button cap 56 is positioned over the button spring 52 on the end of the lifer 46. Depressing the button cap 54 presses on the button spring 52 which in turn releases the lifer 46 from the center bar 38 by allowing the balls 48 to fall into an opening 58 in the center bar.

A compression spring 60 is positioned adjacent an end of lifer opposite from the button cap within the center bar which provides resistance making it more difficult to unintentionally release the center bar and serves to positively lock the center bar assembly when locking the brake bar during use. The center bar assembly further includes a lock ring 62 and washers 64 and 66 to contain the internal mechanisms within the center bar 38. The center bar has a U-shaped channel 68 on its end opposite from button cap for engagement with side leg portion 22 of the U-shaped frame. The brake bar of the present invention is constructed of aluminum and can accommodate ropes 9 mm to 13 mm in diameter. The brake bar is certified to MFTA 1983 general use for 12.5 mm rope that has a MBS of 13.5 kN.

Figure 4A:
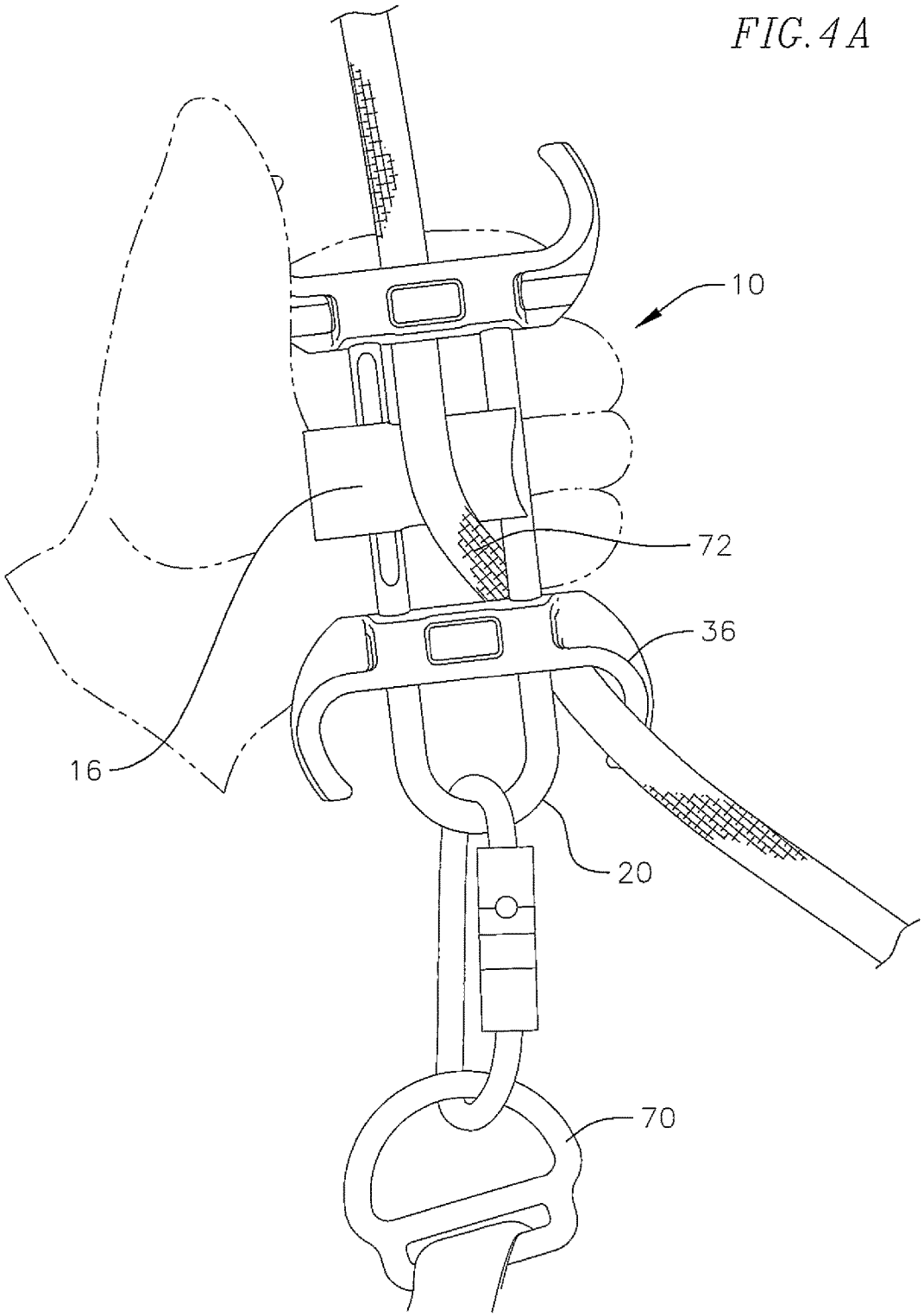
FIGS. 4A and 4B are schematic illustrations of the brake bar of FIG. 1 as threaded with a rope.
Figure 4B:
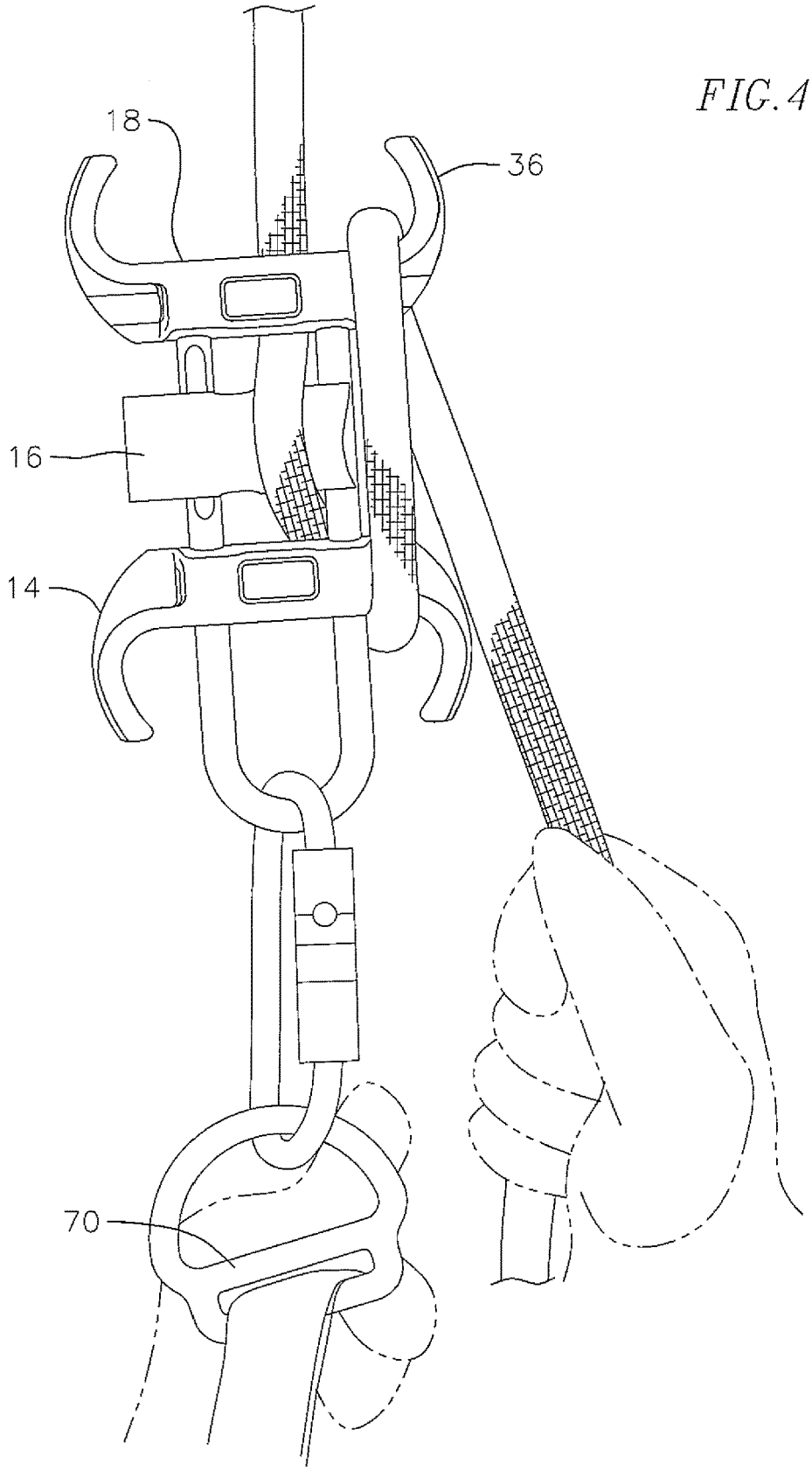

A unique function of the brake bar is that the center bar assembly rotates and secures in place from either side of the frame with the locking mechanism. This construction permits threading of rope into the device from either side which eliminates the concern of possibly misthreading the rope. By way of example, FIGS. 4A and 4B illustrate use of the brake bar 10 of the present invention, for example, by rescue personnel. The closed end portion 20 of the U-shaped frame provides an attachment point to a harness 70. The brake bar can be threaded by first pushing a bite of rope 72 from behind the brake bar trapping the lockable center bar assembly 16 in place. Threading the rope continues in a linear manner along the brake bar wrapping a bottom or rear horn 36 of the sliding friction bar which is then followed by capturing the top horn 36 on the fixed friction bar on the same side. This configuration with two side horns captured provides adequate friction to manage a 2 kN rescue load. The compression action of the sliding friction bar 14 and lockable center bar assembly 16 against the fixed friction bar 18 on the rope removes the need to capture all four horns for managing a rescue load. A lock-off can be accomplished by securing a cleat hitch on both sides of the brake bar, which provides adequate, unattended hard tie-off for security.

The brake bar of the present invention prevents the unintentional swinging movement of the center bar assembly. For example, a brake bar that does not have a lockable center bar assembly could unintentionally open in instances where a user would be backing away from the anchor point to an edge and slackens the rope through the brake bar to reduce friction making it easier to walk backwards which allows the center bar to potentially swing open allowing the brake bar to become disconnected to the rope.

The brake bar of the present invention provides a lockable center bar configuration but can only swing open if the user performs three steps in succession. First, the user must depress the button cap; second, move the lockable center bar assembly back away from the frame to disengage the U-shaped channel from the side leg portion of the frame; and third, swing the center bar open. Once the rope is pulled into the opening of the frame, the user rotates the lockable center bar assembly back towards the closed position and the compression spring snaps the center bar assembly into place engaging the U-shaped channel with the side leg portion. The button cap returns to the locked position and the two balls lock the center bar assembly in place.

Although the present invention has been described and illustrated with respect to a preferred embodiment thereof, it is to be understood that changes and modifications can be made herein that are in the full intended scope of the invention as hereafter claimed.

What is claimed is:

1. A brake bar comprising:

a U-shaped frame;

a sliding friction bar positioned on the U-shaped frame adjacent a closed end of the U-shaped frame;

a fixed friction bar attached on an open end of the U-shaped frame; and a lockable center bar assembly positioned on the U-shaped frame between the sliding friction bar and the fixed friction bar having a center bar with a locking mechanism in an interior of the center bar that selectively engages the center bar.

2. The brake bar of claim 1, wherein the center bar includes a slotted opening for receipt of a side leg portion of the U-shaped frame, and where the U-shaped frame comprises at least two side leg portions, and where the center bar is secured to at least one of the two side leg portions as it rotates.

3. The brake bar of claim 2, wherein the slotted opening provides for the center bar assembly to rotate about the at least one of the two side leg portions of the U-shaped frame when the center bar assembly is in an unlocked position.

4. The brake bar of claim 1, wherein the locking mechanism selectively engages the center bar via spring activated balls within the locking mechanism which engage openings in the center bar.

5. The brake bar of claim 4, wherein the locking mechanism includes a button cap to activate the spring activated balls.

6. The brake bar of claim 1, wherein the locking mechanism is biased within the center bar by a spring.

7. The brake bar of claim 1, wherein the sliding friction bar and the fixed friction bar have curved end portions extending outwardly on opposite ends.

8. A rope control device comprising:

a frame;

a sliding friction bar attached at one end of the frame;

a fixed friction bar attached at an opposite end of the frame; and a center bar having a spring operated locking mechanism arranged interior to the center bar which allows the center bar to be releasablely pivoted on the frame.

9. The rope control device of claim 8, wherein the center bar includes a slotted opening for receipt of a side leg portion of the frame.

10. The rope control device of claim 9, wherein the slotted opening provides for the center bar to rotate about the side leg portion of the frame when the spring operated locking mechanism is in an unlocked position.

11. The rope control device of claim 8, wherein the spring operated locking mechanism includes spring activated balls which engage openings in the center bar.

12. The rope control device of claim 11, wherein the spring operated locking mechanism includes a button cap to disengage the spring activated balls from the openings in the center bar.

13. The rope control device of claim 8, wherein the sliding friction bar and the fixed friction bar have curved end portions extending outwardly on opposite ends.

14. A method of operating a rope control device having at least three bars wherein the three bars are positioned on a frame and one of the three bars is selectively lockable and arranged between and parallel to two of the three bars, the method comprising the steps of:

depressing a lock release mechanism on the selectively lockable bar;

moving the selectively lockable bar away from a portion of the frame; and swinging the selectively lockable bar to an open, unlocked position.

15. The method of claim 14, wherein the step of depressing the lock release mechanism is by activating a release button to disengage the lockable release mechanism.

16. The method of claim 14, wherein the step of moving the selectively lockable bar is by sliding the selectively lockable bar in a slotted opening in the selectively lockable bar.

17. The method of claim 16, wherein the step of swinging the selectively lockable bar to the unlocked position is by rotating the selectively lockable bar in the slotted opening about a portion of the frame.

* * * * *